US006366008B1

(12) United States Patent
Fukushima et al.

(10) Patent No.: US 6,366,008 B1
(45) Date of Patent: Apr. 2, 2002

(54) SPARK PLUG AND METHOD OF MAKING THE SAME

(75) Inventors: Osamu Fukushima; Makoto Sugimoto; Hiroyuki Tanabe, all of Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/886,101

(22) Filed: Jun. 22, 2001

(30) Foreign Application Priority Data

Jun. 23, 2000 (JP) ..... 2000-188973
May 15, 2001 (JP) ..... 2001-144611

(51) Int. Cl.[7] ..... H01T 13/20
(52) U.S. Cl. ..... 313/141; 313/118
(58) Field of Search ..... 313/118, 130, 313/135, 137, 141, 144

(56) References Cited

U.S. PATENT DOCUMENTS 4,193,012 A 3/1980 Podiak et al.

FOREIGN PATENT DOCUMENTS

EP 1 005 125 A2 3/2000

*Primary Examiner*—Vip Patel
(74) *Attorney, Agent, or Firm*—Morgan, Lewis & Bockius LLP

(57) ABSTRACT

A spark plug comprises: a center electrode (3); an insulator (2) provided around the center electrode (3); a metal shell (1) provided around the insulator (2); a ground electrode (4) disposed in opposition to the center electrode (3) so as to form a spark discharge gap; and a sealing-material layer (61) comprising a sealing material, wherein the sealing material comprises talc, and the sealing material is filled in a space between the inner face of the metal shell (1) and the outer face of the insulator (2), so as to seal the space, wherein the sealing material has a filling density of 1.5 g/cm$^3$ to 3.0 g/cm$^3$, or the sealing-material layer (61) comprises at least one of an inorganic material and a silicone binder in an amount of 2 to 7 wt %.

10 Claims, 10 Drawing Sheets

SPARK PLUG AND METHOD OF MAKING THE SAME

BACKGROUND OF THE INVENTION

1. Field of the Invention

This invention relates to a spark plug and a method of making the same.

2. Description of the Related Art

Conventionally, spark plugs have been known which have a sealing material layer composed mainly of talc filled in a space between the outer face of the insulator and the inner face of the metal shell so as to seal the space for checking gas leakage from a combustion chamber. The spark plug is exposed to high temperatures and high pressure because of influences by combustion gas generated in a combustion process within the combustion chamber, and sometimes served under severe circumstances receiving vibrations, and therefore the spark plug is demanded to meet needs for completing performance under such circumstances, and in particular it is desirable to sufficiently secure a sealing property in a sealing material.

Of late, direct injection of gasoline or lean-burn system has extensively been progressed as instruments for realizing high output and low fuel combustion. Such an engine is apt to enlarge a valve diameter or bring valve position nearly to a plug hole at a center of the cylinder head, and a demand for making the spark plug small size has been arisen to reduce the diameter thereof as possible. Practically, a distance between two parallel opposite faces of a tool engaging portion for attaching the engine for fitting such as a wrench is conventionally 16 mm or more, and it has been required to reduce from 16 mm to less than 16 mm as 14 mm. While satisfying the demand for miniaturization, it has been called for to provide a spark plug considered to have a sealing property (anti-looseness) and impact resistance.

SUMMARY OF THE INVENTION

Accordingly, it is an object of the invention to provide such a spark plug having a sealing material layer, enabling to secure an excellent sealing property under circumstances at high temperature, using powder of talc as a main component. In particular, it is an object to provide a miniaturized spark plug excellent in the impact resistance and the sealing property and a method of making the same.

For solving the above mentioned problems, the invention is to provide a spark plug having a center electrode, an insulator provided around the center electrode, a metal shell provided around the insulator and a ground electrode disposed in opposition to the center electrode so as to form a spark discharge gap, and having a sealing material composed mainly of talc filled in a space between the inner face of the metal shell and the outer face of the insulator so as to seal the space, characterized in that a packing density of the sealing material is 1.5 g/cm$^3$ to 3.0 g/cm$^3$.

If the sealing material layer is filled in the space between the inner face of the metal shell and the outer face of the insulator such that a packing density of the sealing material is 1.5 g/cm$^3$ to 3.0 g/cm$^3$, compressibility of the sealing material is remarkably improved and the sealing property of the sealing material layer is heightened. Thus, if being exposed to severe using conditions to generate load in the sealing material layer by vibration, pressure and others, air tightness can be well secured between the metal shell and the insulator. Especially in the spark plug, when taking, as a front side, a side where the spark discharge gap is formed, a rear-side circumferential part of the metal shell defines a press-fitting portion facing outside, deterioration is difficult to happen even at high temperature and high pressure depending on the above mentioned sealing material layer, and the press-fitting portion can be usefully controlled from loosening to heighten the sealing property.

In the spark plug, when a distance between two parallel opposite faces of the tool engaging portion (called as "opposite side sizes" hereafter) to be formed 6 in the metal shell for attaching the engine is W, W<16 mm, an inner diameter $D_S$ of a portion surrounding the sealing material layer in the metal shell satisfies 9.0 mm<$D_S$<13.0 mm, and when an outer diameter of a portion surrounded by the sealing material layer in the insulator is $D_I$, $D_S-D_I>1.6$ mm and $D_I \geqq 7.0$ mm, and it is desirable that the filling density of the sealing material is 1.5 g/cm$^3$ to 3.0 g/cm$^3$.

In the small sized spark plug, the metal shell and the insulator are required to reduce diameter. Specifically, the opposite side sizes are required to be less than 16 mm. On the other hand, from the viewpoint of mechanical strength of the spark plug, the size reduction of the insulator is limited to keep enough strength. It is accordingly assumed that the sealing material layer is not furnished between the metal shell and the insulator, and such a spark plug is structured to have a large diameter of the insulator. However, the spark plug designed not to have a sealing material layer is involved with problems that the impact resistance is weak and the air-tightness is considerably lowered after giving impact. Such problems are remarkable in a spark plug, wherein the opposite side sizes of the tool engaging portion are less than 16 mm, because inevitable lack of thickness of the metal shell decreases strength thereof.

In the small sized spark plug of the opposite side sizes being less than 16 mm, the sizes of the insulator and the metal shell are determined as mentioned above (as in a second invention), and the sealing material layer is furnished between the metal shell and the insulator so as to moderate impact to the metal shell, effecting as a buffer, thereby enabling to realize a structure satisfying the impact resistance and the air-tightness. Especially, if furnished with the sealing material layer where the filling density is adjusted to range 1.5 g/cm$^3$ to 3.0 g/cm$^3$ difference in diameter between the inner face of the metal shell and the outer face of the insulator is shortened in comparison with conventional ones, and even in the small sized spark plug limiting the amount of the sealing material layer, the structure having excellent impact resistance and air-tightness can be realized.

A miniaturization of the spark plug reduces the difference in diameter between the inner face of the metal shell and the outer face of the insulator, and by making $D_S-D_I>1.6$ mm in said difference, it is possible to pack the sealing material layer uniformly and at a proper density (the filling density of 1.5 g/cm$^3$ to 3.0 g/cm$^3$) in the gap between the metal shell and the insulator. If the difference of $D_S-D_I$ is less than 1.6 mm, when filled with powder, the difference is too small to be filled with the sealing material layer On the other hand, when a shaped body (ring), which is preliminary shaped with powder, is disposed (filled) in the space between the metal shell and the insulator, the thickness of the ring should be less than 0.8 mm. However, the difficulties in forming thin ring brings may result in lower strength. Further, if the outer diameter $D_I$ of the insulator is less than 7.0 mm, insufficient strength thereof results in inferior function of the spark plug. On the contrary, if being $D_I>7.0$ mm, enough strength can be given to the insulator.

By the way, in the spark plug as mentioned above since it is structurally difficult to make thickness of the metal shell (actually, thickness of the tool engaging portion) larger than necessary. Therefore, if the filling density is larger than 3.0 g/cm$^3$, high pressing pressure should be applied when the sealing material layer is filled. Such high pressure may causes deformation of the tool engaging portion, which results in deviation from tolerance. Therefore, it is desirable that the filling density of the sealing material layer is 3.0 g/cm$^3$ in the above size determination (that is, W<16 mm, 9.0 mm<$D_S$<13.0 mm, $D_S$–$D_I$>1.6 mm and $D_I$>7.0 mm). Thus, if the filling density of the sealing material layer is 3.0 g/cm$^3$ or lower, even in the miniaturized spark plug difficult to make thickness of the metal shell large, the filling density can be increased as limiting deformation of the metal shell within tolerance, resulting in high precision. The opposite side size W is desirably 12 mm or more to keep sufficient strength.

The invention is further concerned with a method of making the above mentioned spark plug, comprising a filling process for forming powder filled layer by locating the insulator inside of the metal shell and filling powder of sealing material being main of talc in the space between the metal shell and the insulator, a compression process for compressing the powder filled layer under the above mentioned condition so as to form the sealing material layer, and a forming process for, prior to the filling process, forming the filled powder in ring shape corresponding to said space, wherein, in the above filling process, the formed body of the filled powder is located in said space, and in the compression process, the formed body as the powder filled layer is compressed at higher pressure than that in the forming process, whereby the sealing material layer is formed having a filling density of 1.5 g/cm$^3$ to 3.0 g/cm$^3$.

If performing the forming process for, prior to the filling process, forming the filled powder in ring shape corresponding to said space, raw material powder of a fixed amount can be charged easily and exactly into a narrow space between the metal shell and the insulator, contributing to heightening of production efficiency It is desirable that, prior to carrying out the forming process, to adjust in advance average diameter of talc powder ranging 30 to 200 $\mu$m, and apparent density of the talc powder to be 0.5 g/cm$^3$ to 1.3 g/cm$^3$. Namely, it is recommended to use the talc powder adjusted to be in this range in the forming process. By adjusting the apparent density, the ring shaped body composed of mainly the talc powder can be formed with adequate strength, and therefore the sealing material layer can be provided with an appropriate density.

If the apparent density is less than 0.5 g/cm$^3$, the ring shaped body may be short in strength, and consequently, it is difficult to form the sealing material layer with the enough filling density and with the uniform density. On the other hand, if exceeding 1.3 g/cm$^3$, the pressing pressure must be large when filling the sealing material layer (the formed body), resulting in that the tool engaging portion will be probably deformed by said pressing pressure as deviating from tolerance. Further, if the sealing material power adjusted ranging 30 $\mu$m to 200 $\mu$m, the apparent density can be determined to be precisely high. If the average diameter is less than 30 $\mu$m or more than 200 $\mu$m, it is difficult to provide a suited apparent density. The average diameter is desirably 80 to 150 $\mu$m.

Actually, it is possible to equip a raw material powder producing process for mixing the talc powder adjusted in the above range and a binder as well as a filling powder material producing process for producing the filling powder as adjusting the raw material powder to be predetermined diameter. The sealing material layer is composed of the sealing material powder. These procedures will be mentioned in detail later.

DETAILED DESCRIPTION OF THE INVENTION

Figure 1:
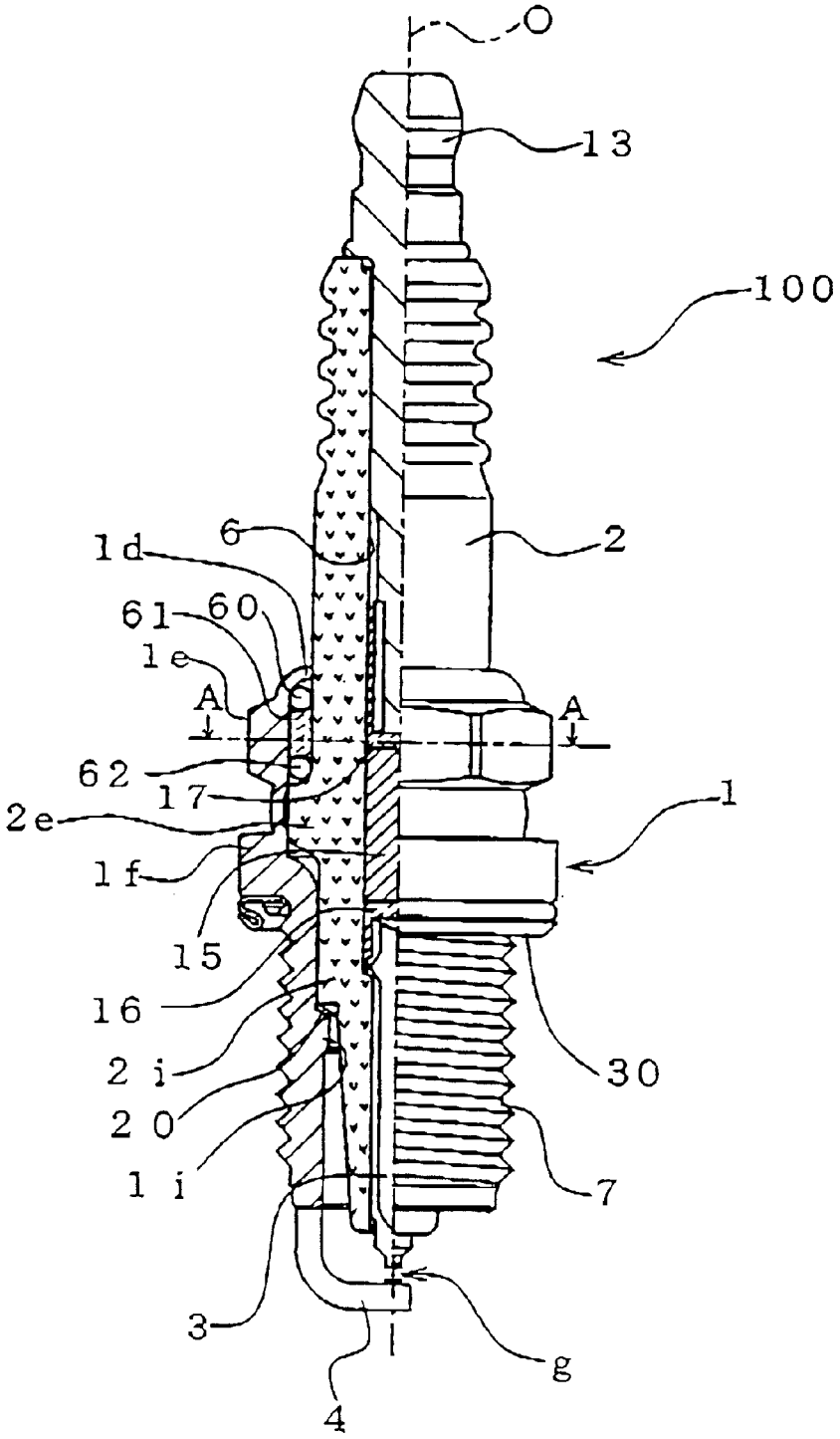
FIG. 1 is a vertically half-cross sectional view showing the spark plug as one embodiment of the invention.

Explanation will be made to the embodiments for carrying out the invention with reference to the attached drawings. The spark plug 100 having a resistor as an example of the invention shown in FIG. 1 comprises a cylindrical metal shell 1, an insulator 2 fitted in the inside of the metal shell 1 with its tip 21 projecting from the front end of the metal shell 1, a center electrode 3 disposed inside the insulator 2 with its tip thereof projecting, and a ground electrode 4 with its one end connected to the metal shell 1 and the other end facing the tip of the center electrode 3. Between the ground electrode 4 and the center electrode 4, a spark gap g is formed.

The insulator 2 is composed of, e.g., a ceramic sintered substance such as alumina or aluminum nitride, and has a through-hole 6 in its interior for fitting the center electrode 3 penetrating in the axial direction. A terminal fixture 13 is inserted and fixed in one end of the through-hole 6, and the center electrode 3 is inserted and fixed in the other end thereof. A resistor 15 is disposed in the through-hole 6 between the terminal metal fixture 13 and the center electrode 3. The resistor 15 is electrically connected at each end thereof to the center electrode 3 and the terminal metal fixture 13 via the conductive glass seal layers 16 and 17, respectively.

The metal shell 1 is formed to be cylindrical of such as a low carbon steel to compose a housing of the sparkplug 100. It has a thread 7 there around for screwing the spark plug 100 into an engine block (not shown). Symbol 1*e* is a hexagonal nut portion over which a tool such as a spanner or wrench fits to fasten the metal shell 1. On the other hand, a ring shaped packing (a line packing 62) is located for engaging a rear-side periphery of a flange shaped projection 2*e* (also called as "first insulator-side engaging projection 2*e*" hereafter) at a space shaped in ring defined between an inside of a rear-side opening part of the metal shell 1 and an outside of the insulator 2. At a further rear side, a ring shaped packing (packing 60) is disposed via the sealing material layer 61. The insulator 2 is inserted forward into the metal shell 1, and under this condition the metal shell 1 is caulked at its rear-side periphery toward the packing 60, thereby forming a caulked part, so that the insulator 2 is secured to the metal shell 1.

The metal shell 1 is mounted at a base part of a thread portion 7 with a gasket 30 which is a ring shaped part by bending a metal blank sheet as carbon steel, and the thread portion 7 is screwed into a thread hole of the cylinder head side and is axially compressed and deformed as crushed between an opening peripheral part of the thread hole and a flange shaped gas sealing part 1*f* formed at a more front side than the tool engaging portion of the metal shell 1, so that the gasket 30 plays a role sealing a gap between the thread hole and the thread portion 7.

Next, the sealing material layer 61 will be explained.

In the spark plug 100 according to the invention, the sealing material layer 61 is charged such that the filling density is 1.5 to 3.0 g/cm$^3$ in the ring shaped space formed between the inside of the metal shell 1 and the outside of the insulator 2. By charging as satisfying this range, high compression is maintained and the impact resistance is increased. Incidentally, preferable is 2.0 to 3.0 g/cm$^3$. If the filling density of the sealing material layer 61 is 2.0 g/cm$^3$ or higher, the impact resistance is more increased and the high compression is maintained remarkably favorable. The sealing material layer 61 contains binder which is desirably kept liquid at a room temperature (25° C.) and 150° C. at the boiling point. Thereby, heat resistance of the sealing material layer 61 is increased and quality is maintained stable at high temperatures (that is, unlikely to deteriorate even at high temperatures). As preferable examples of binders to be used to the sealing material layer 61, inorganic materials (also called as "inorganic binder" hereafter) as water glass, colloidal silica, or aluminum phosphate or silicone (also called as "silicone based binder" hereafter) as silicone oil or silicone varnish maybe contained. If such inorganic materials or silicone is used as the binder, the sealing material layer 61 is unlikely to denature even under the severe using condition at high temperatures, and high compression is maintained satisfactory to enhance the sealing property.

It is desirable that the binder (practically, the inorganic binder or silicone based binder) having the above mentioned properties is 2 to 7 wt % in the sealing material powder or the sealing material. In case that the containing amount of the binder is less than 2 wt %, an insufficient effect for improving compressibility of the sealing material powder may spoil the sealing property of the sealing material layer at high temperatures. On the other hand, being more than 7 wt %, fluidity of the sealing material powder is damaged to invite occurrence of bad sealing or decrease of production yield of the spark plug owing to inconveniences as mentioned under when producing a spark plug.

1: In a case of employing a process of directly charging the sealing material powder into the space between the metal shell and the insulator and compressing it, a smooth inflow of the powder into said space is obstructed.

2: In a case of employing a process of preliminarily forming the sealing material powder by a mold press, and arranging an obtained formed body in said space, a smooth inflow of the powder into a cavity of the mold is obstructed.

The containing amount of the binder is desirably 3 to 5 wt %.

Figure 9A:
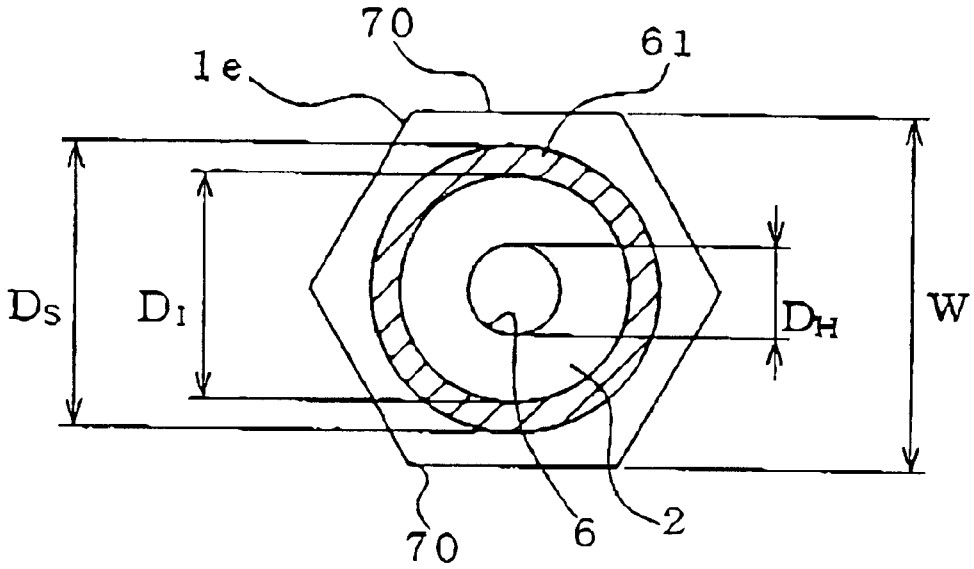
FIGS. 9A and 9B are plan views of A—A line of FIG. 1, and of 24 corners (Bi-HEX shape)
Figure 10:
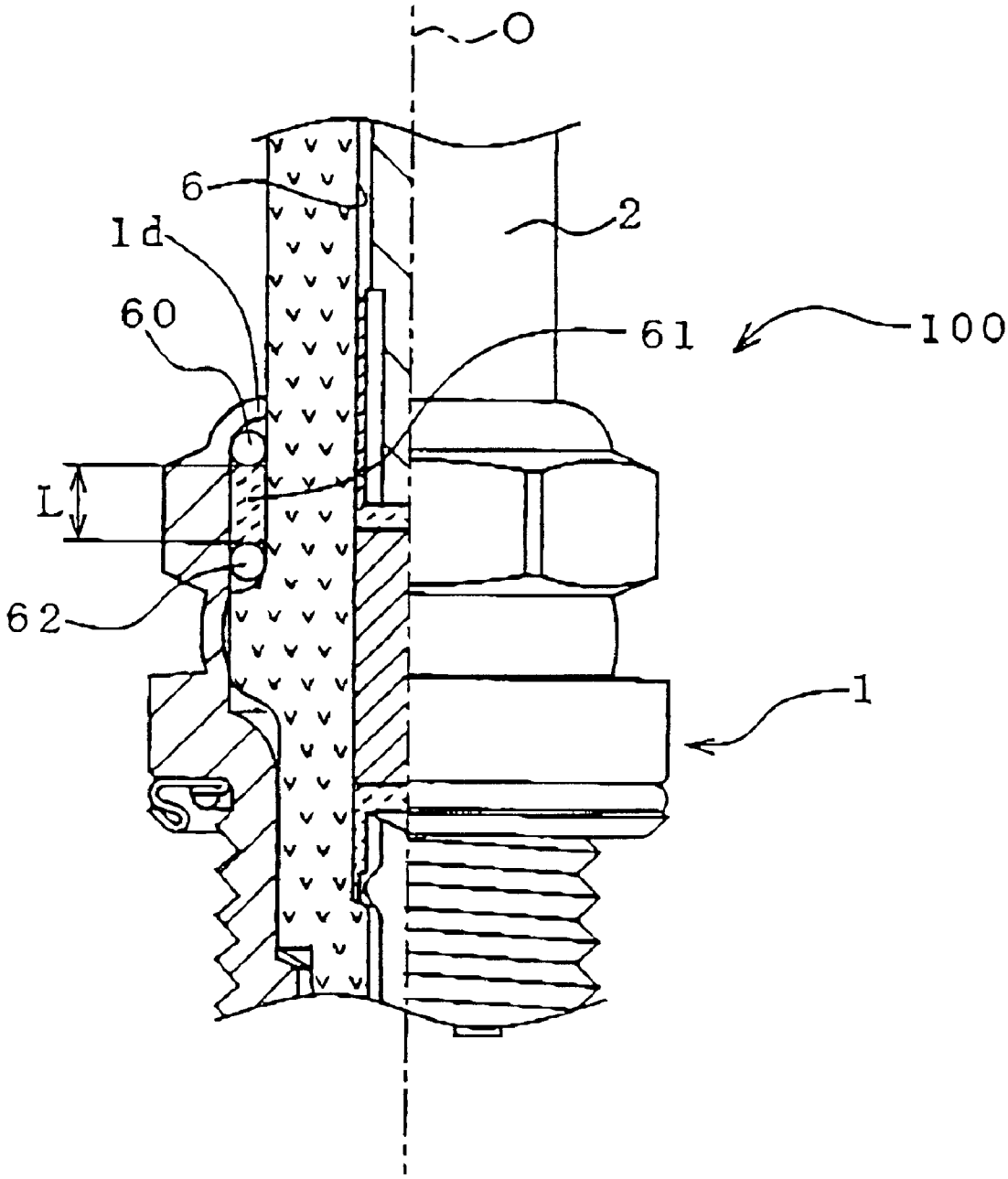
FIG. 10 is an enlarged view of FIG. 1.

As seen in a plan view in FIG. 9A (A-Across sectional view of FIG. 1), the tool engaging portion 1*e* has a side of a tool working face 70 formed in hexagon seen in plan (so-called HEX shape) to which a tool (such as a spark plug wrench) engages and works and in which a distance W (i.e., opposite side size of outsides in plan) between opposite sides of two parallel faces in plan (tool working faces 70, 70) Is less than 16 mm. such a spark plug of the opposite-face distance being less than 16 mm is designed such that an inner diameter $D_S$ of a portion encircling the sealing material layer 61 in the metal shell 1 satisfies 9.0 mm<$D_S$<13.0 mm, and the outer diameter $D_I$ of a portion encircled by the sealing material layer 61 in the insulator 2 satisfies $D_S-D_I>1.6$ mm and $D_I \geqq 7.0$ mm. In the invention, the portion encircled by the sealing material layer 61 means a portion between opposite edges of the packing 60 and the line packing 62 with respect to the axial direction (a direction of a center axial line O (FIGS. 1 and 10) of the spark plug 100) In other words, in case taking, as a front side, a side arranged with a spark discharge gap g in the spark plug 100, said portion means a portion between a rear end in the axial direction of the line packing 62 and a front end in the axial direction of the packing 60. FIG. 10 shows the distance therebetween as a distance L between the ends in the axial direction. The outer diameter $D_I$ of the insulator 2 in the range of the distance L between the ends in the axial direction and the inner diameter $D_S$ in the same are determined in the above ranges, respectively.

In the spark plug dimensionally designed as mentioned above, the filling density of the sealing material layer 61 is adjusted to be 1.5 to 3.0 g/cm$^3$. If being 2.5g/cm$^3$or lower, the small sized spark plug ranging the above dimensions is more effective. Being determined 2.0 to 2.5 g/cm$^3$, the impact resistance and the air-tightness can be more heightened, and it is possible to realize the suitable spark plug of high shape precision.

In the invention, the filling density of the sealing material layer shall be calculated as follows.

Assuming that 1) volume (hereinafter called as "space volume between the ends") of the space (ring shaped space) defined by the outer periphery of the insulator and the inner periphery of the metal shell between the ends in the axial direction of packings adjacent to both ends in the axial direction of the sealing material layer (i.e., between the rear end in the axial direction of packing (in FIG. 10, the line packing 62) adjacent to the front side of the sealing material layer and the front end in the axial direction of the packing adjacent to the rear side of the sealing material layer (in FIG. 10, the packing 60) is V, and 2) mass of the whole sealing material layer filled between the inner surface of the metal shell and the outer surface of the insulator is M, a value of M/V is defined as the filling density As the distance between the ends in the axial direction of both packings is defined as L as shown in FIG. 10, the space volume V between the ends is $V=(D_S-D_I)\times L$. In case the filling density is ρ, $\rho=M/(D_S-D_I)\times L$) is defined. If ρ according to this formula is 1.5 g/cm$^3 \leqq \rho \leqq 3.0$ g/cm$^3$, it falls within the technical range of the invention. The same is applied to another preferable example (if ρ is 2.0 g/cm$^3 \leqq \rho \leqq 2.5$ g/cm$^3$, it falls within the preferable range).

Actually, the dimensions W, $D_S$, $D_I$ of FIG. 9A may exemplify W 14 mm, $D_S$=11.2 mm, $D_I$=9.0 mm, otherwise W=12 mm, $D_S$=9.2 mm, $D_I$=7.0 mm. The small sized spark plug of the distance between the opposite faces (the opposite side size) W being less than 16 mm (14 mm or 12 mm) may use other various sizes.

Figure 9B:
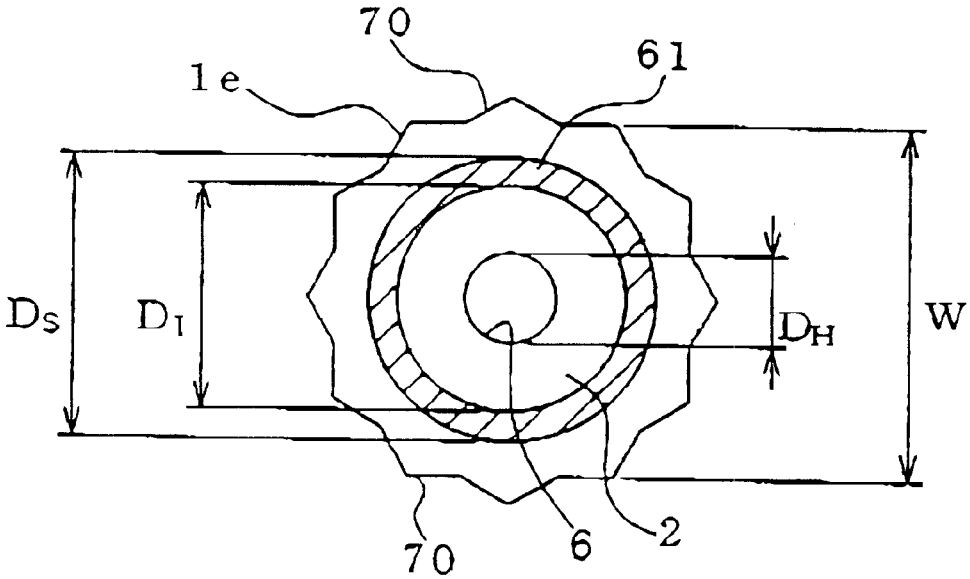

The tool engaging portion le of the metal shell 1 is not limited to the hexagon, and as seen in FIG. 9B, a tool engaging portion of 24 corner shape (so-called Bi-HEX shape) may be used. Also in this case, the dimensions are determined in the above mentioned range. Such dimensional examples may be available, in the sizes W, $D_S$, $D_I$ of FIG. 9B, as W14 mm, $D_S$=12 mm, $D_I$=10.5 mm, otherwise the opposite faces (the opposite side size) W may be small sized as being less than 16 mm (12 mm, 14 mm) as W=12 mm, $D_S$=9.7 mm, $D_I$=7.5 mm. Further, in any of HEX and Bi-HEX, the inner diameter $D_H$ of the insulator 2 formed to be hollow having the through-hole 6 (i.e., the diameter of the through-hole 6 corresponding to a part disposed with the sealing material sayer) is determined to be 3.0 mm or more (e.g., 3.0 mm, 3.5 mm)

Figure 2:
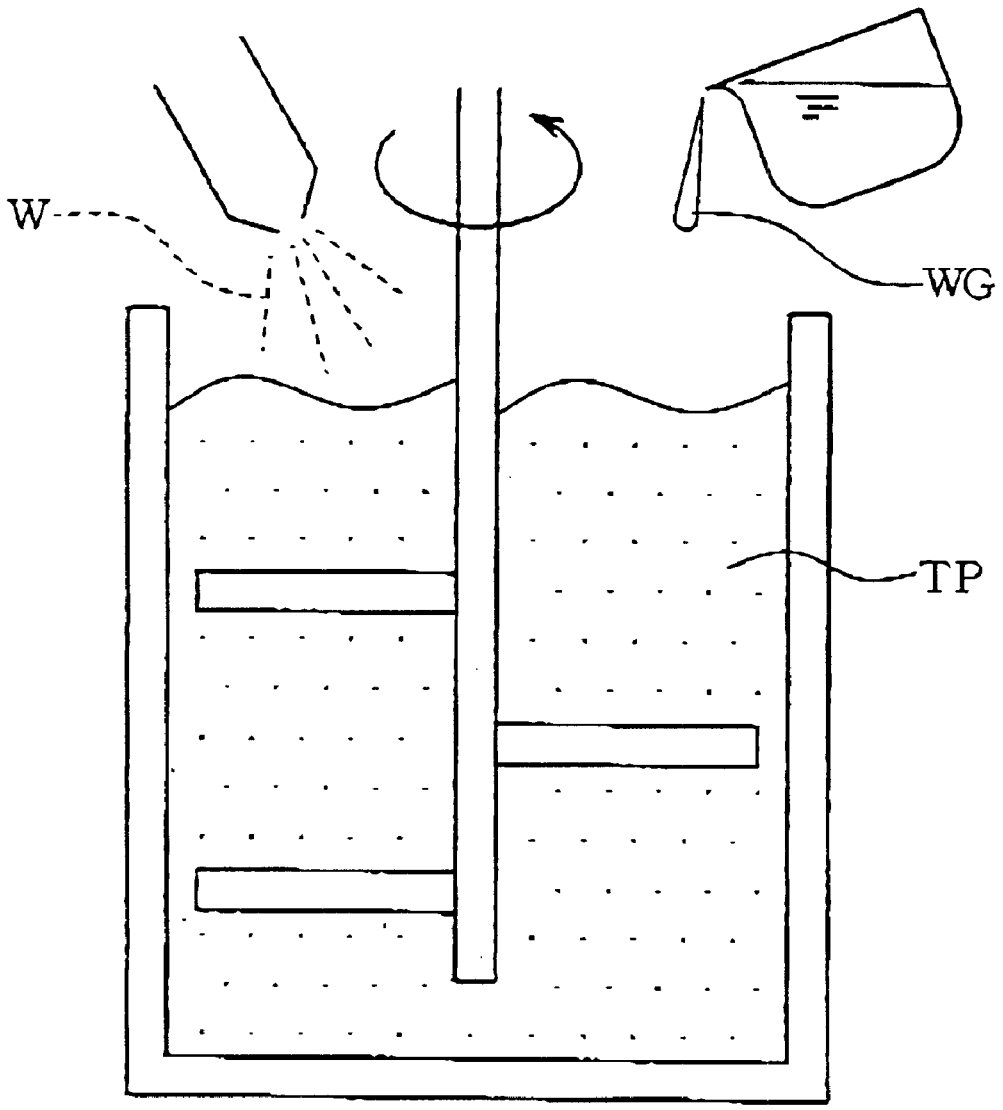
FIG. 2 is an explanatory view of the adjusting process of the sealing material powder to be used to the spark plug of FIG. 1.

Explanation will be made to the production of the spark plug 100. The water glass will be exemplified as the binder, but the same production may be also served to the inorganic binder or silicone based binder. As shown in FIG. 2, to the talc powder TP, the water glass WG and the water W of designated amounts are compounded, and mixed to agitate so as to carry out the raw material powder production process for producing raw material powder LP. The talc powder TP is in advance adjusted to be 30 to 200 $\mu$m in the average diameter, and the apparent density is adjusted to be 0.5 to 1.3 g/cm$^3$. If adjusting the apparent density as such, it is possible to form a ring shaped body to be appropriate density in a later mentioned forming process. Further, by adjusting the average diameter in the above mentioned range, the apparent density is easily adjusted in said range, and after filling, the sealing material layer is easily formed to be a proper density, while maintaining the forming precision of the metal shell.

A compounding amount of the water is as important as that of the water glass WG, which will be explained in detail later. A water solution of e. g., sodium silicate or potassium silicate (or a mixture of them) is preferably used as a water glass, and for silicate component, $M_2O.n\ SiO_2$ (M is Na or K) is used. The solution is added in a reasonable amount, considering mixture easiness into the sealing material powder. The water glass in the sealing material or in the sealing material layer has a water containing ratio of 1:1. It is recommended that the water content in the talc powder TP to be used is 0.5 to 3.5 wt %. Being less than 0.5 wt %, compressibility of the sealing material powder goes down. Being more than 3.5 wt %, the excessive water content in the sealing material powder to be obtained may spoil the fluidity.

Figure 3A:
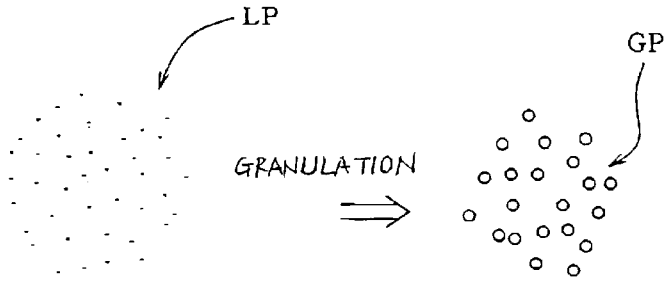
FIGS. 3A to 3E are explanatory views of granulating and forming processes of the filled material powder.

The sealing material powder producing process is carried out as follows. As shown in FIG. 3A, the raw material powder LP is granulated for improving the fluidity and turns out a granulated sealing material powder GP. The granule production may depend on known methods, and for example, such a method is enumerated that the raw material powder LP is compressed through a pair of rolls into a plate shape, and this plate is pulverized and graded (e.g., classified by screening) to produce granule sealing material GP.

Figure 3B:
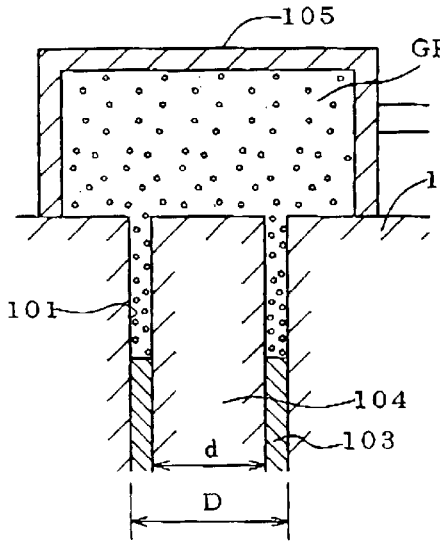
Figure 3C:
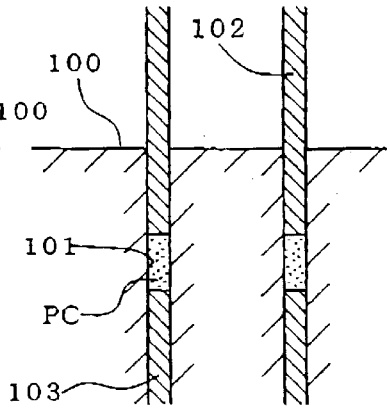
Figure 3D:
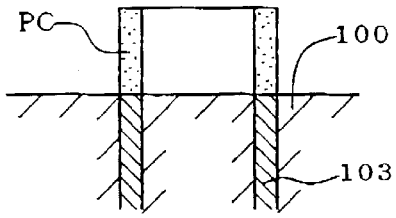

As shown in FIGS. 3B to 3D, the granule sealing material GP is charged into a cavity 101 of a mold 100 (104 designates a core for forming voids in a formed body) by means of a box feeder 105, and is compressed by punches 102, 103 to produce a formed body PC of the sealing material powder.

Figure 3E:
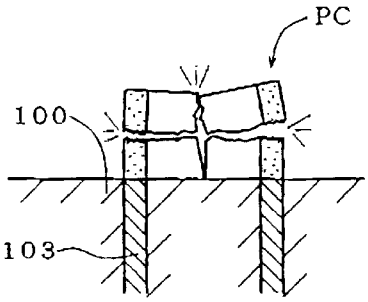

It is desirable that the sealing material powder is compressed in the forming process such that the apparent density of the formed body PC to be obtained is 2 to 2.4 g/cm$^3$. Being less than 2 g/cm$^3$, strength of the formed body PC will be insufficient, and inconveniences as a crack or breakage of the formed body will be caused by small impact. On the other hand, being more than 2.4 g/cm$^3$, compression of the formed body in the cavity 103 of the mold is necessary. Therefore, for example, as shown in FIG. 3E, friction between the inner surface of the cavity 101 and the formed body PC becomes large, and when releasing the formed body PC from the mold 100, cracking or breaking is likely to occur. The apparent density is more preferably adjusted to be 2.2 to 2.3 g/cm$^3$.

For producing the formed body PC by the mold press, desirably the water content of the sealing material powder to be formed by the mold press is adjusted ranging 1.5 to 3.5 wt %. Being less than 1.5 wt %, it will be difficult to secure the apparent density of the formed body PC at values of 2 g/cm$^3$ or higher. Being more than 3.5 wt %, the poor fluidity of the sealing material powder might prevent smooth supply of the sealing material powder into the mold cavity.

An assembling process of the spark plug will be explained as follows.

Figure 5:
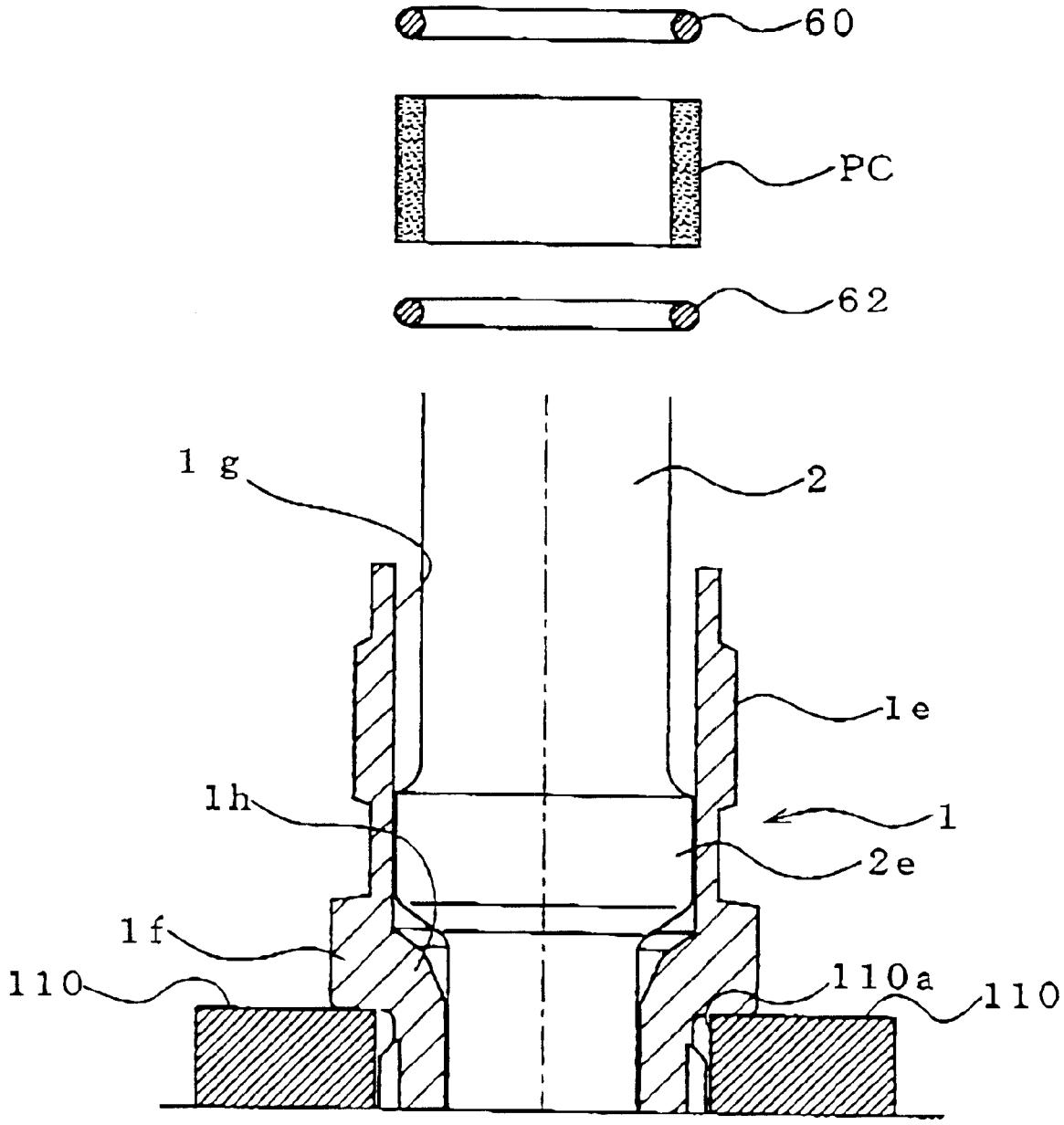
FIG. 5 is an explanatory view of the process setting up the spark plug.

As shown in FIG. 5, the metal shell 1 is formed along the inner circumference thereof with a first engaging projection 1*h* shaped in ring of the metal shell-side. In contrast, the insulator 2 is, as mentioned above, formed along the outer circumference thereof with a first engaging projection 2*e* shaped in ring of the insulator-side. In this embodiment, an insertion hole 1*g* of the metal shell 1 is diameter-reduced at the front end by a step which serves as the first engaging projection 1*h* of the metal shell-side.

FIG. 5 shows a state (before forming the press-fitting part 1*d* (FIG. 1)) where a plate packing 20 (see FIG. 1) is inserted into the metal shell 1, and then the insulator 2 is inserted until a position of sandwiching a second engaging projection 2*i* (see FIG. 1) of the insulator-side to be formed in the insulator 2 and the plate packing 20.

Next, a process of forming the sealing material layer 61 at the space between the metal shell 1 and the insulator 2. As shown in FIG. 5, after inserting the insulator 2, the line packing 62 is inserted in the space between the metal shell 1 and the insulator 2, and subsequently a filling process is performed for filling the sealing material powder into the space. In FIG. 5, the sealing material powder supplied as the formed body PC into the space to form the powder filled layer.

Figure 6:
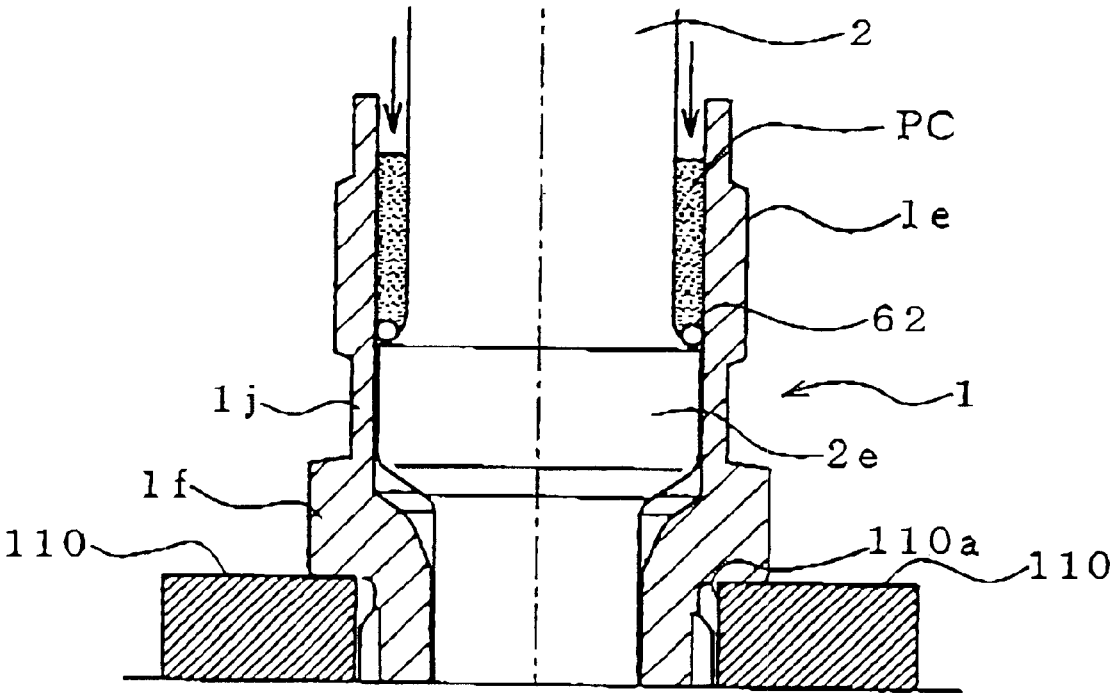
FIG. 6 is an explanatory view continuing from FIG. 5.
Figure 7:
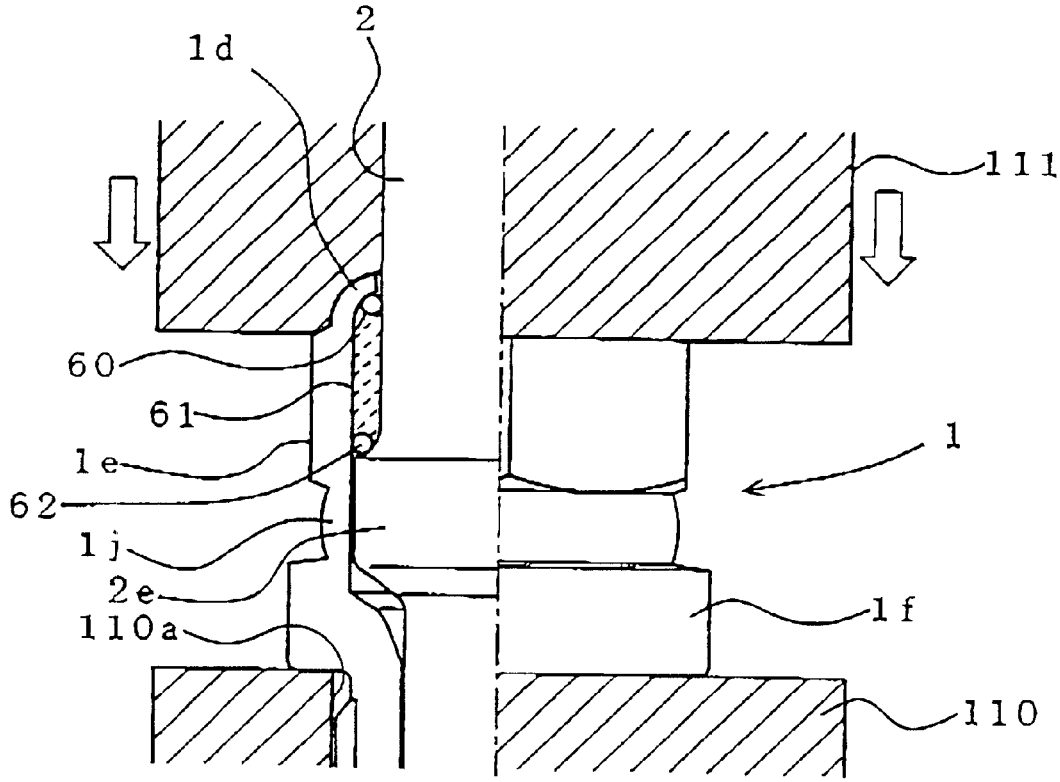
FIG. 7 is an explanatory view continuing from FIG. 6.

After inserting the formed body PC, a compression process is performed as shown in FIG. 6 for compressing the formed body PC (the powder filled layer) in the axial direction of the metal shell 1 by means of such as a pipe. The compression force is set to be higher than that at forming the formed body PC, whereby the formed body PC turns out the sealing material layer 61 as shown in FIG. 7. Thus, prior to the filling process, the forming process is practiced for shaping into the ring, and in the filling process, the formed body of the sealing material powder is located in the space. In the compression process, the formed body is compressed at higher pressure than that in the forming process, so that the raw material powder of the desired amount can be charged easily and exactly in the narrow space between the insulator and the metal shell, and the compression force can be uniformly effected to the powder filled layer, and therefore the sealing property of the sealing material layer to be formed can be made satisfactory.

If the rear-side periphery of the metal shell 1 is compressed as seen in FIG. 7 to be bent inward and caulked toward the insulator, so that the press-fitting part 1*d* is formed. The formation of the press-fitting part 1*d* keeps sealing material layer 61 in the compressed condition, and the good sealing property is displayed continuously.

Practically in FIG. 7, the metal shell 1 is inserted at the front end in to a setting hole 110*a* of a press-fitting base 110, and a flange shaped gas sealing part 1*f* formed in the metal shell 1 is supported on the opening circumference thereof. Under this condition, a press-fitting punch 111 is brought to the rear face of the metal shell 1, and the metal shell 1 is held between the press-fitting base 110 and the press-fitting punch 111, thereby bending to deform a thin part 1*j* formed between the tool engaging portion 1*e* and the gas sealing portion 1*f*, while the rear-side periphery of the metal shell 1 is caulked inward toward the packing 60, so that the caulked part 1*d* is formed. At this time, accompanied with the inward deformation in the rear end opening part of the metal shell by forming the caulked part 1*d* and the bent deformation of the thin part 1*j*, the caulked part 1*d* and the first engaging projection 2*e* of the insulator-side compress the formed body PC (the powder filled layer) to form the sealing material layer 61. That is, the press-fitting of the metal shell 1 and the compression of the powder filled layer are performed simultaneously.

As the forming method of the caulked part 1*d*, not only the above procedure (cold press-fitting) but also a hot press-fitting may be employed. The forming of the caulked part 1*d* by the hot press-fitting is, as shown in FIG. 7, carried out by pressing the metal shell between the press-fitting base 110 and the press-fitting punch 111, and under this condition, current (for example, around 100A) is supplied between the press-fitting base 110 and the press-fitting punch 111 for 0.5 to 1 sec. The current flows from the press-fitting punch 111 via the tool engaging portion 1*e*, the thin part 1*j* and the gas sealing part 1*f* to the press-fitting base 110. Then, since the thin part 1*j* is smallest in thickness and high in resistant value, only this part is red-heated. Thereby, the forming of the caulked part 1*d* and the compression of the powder filled layer are carried out simultaneously, and load to be taken for bending to deform the thin part 1*j* is decreased, and the small load is enough to caulk.

Whether the spark plug is formed by the cold press-fitting or the hot press-fitting is easily found by observing a half-divided spark plug. In the spark plug by the cold press-fitting (see FIG. 7), the thin part 1*j* bent and deformed is deformed biasing toward one side of the outside or the inside in the radius direction (in FIG. 7, the outside). On the other hand, in the spark plug by the hot press-fitting, the thin part 1*j* is deformed as expanded to both of the outside and the inside in the radius direction.

In the above compression process, the water content in the powder filled layer to be compressed (in this case, the formed body PC) is preferably 0.5 to 3.5 wt %. Being less than 0.5 wt %, the compressibility of the powder is spoiled, and the air-tightness of the sealing material layer 61 to be obtained might be insufficient. Being more than 3.5 wt %, an inconvenience may occur that the powder filled layer leaks into spaces among adjacent members.

When using the formed body PC, in the forming process as mentioned above, desirably the water content of the filled material powder is adjusted to be 1.5 to 3.5 wt %. If using such water content, the water content of the formed body PC immediately after forming almost ranges 1.5 to 3.5 wt %. This has no problem since said range belongs to a desirable water content in the subsequent compression process. Reversely considering, since the desirable water content in the powder filled layer is lower than the desirable range when forming, if the water content in the formed body PC goes down owing to such as evaporation until practicing the compression process, there is no problem for practicing the compression process, if the water remains 0.5 wt % or more.

Figure 4:
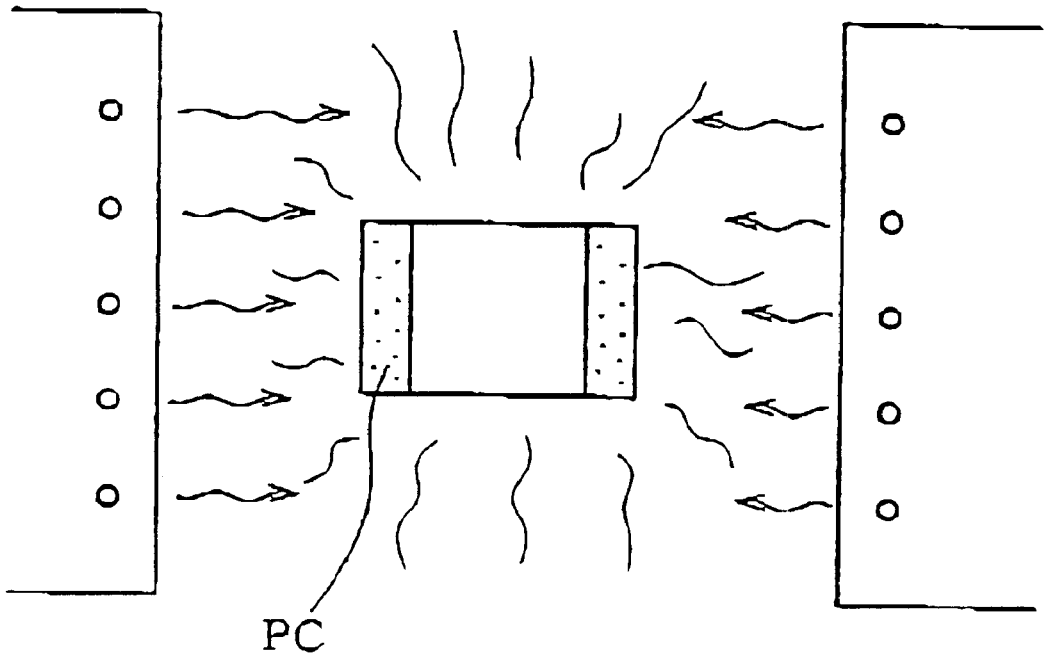
FIG. 4 is an explanatory view of a method of heating the formed body and adjusting the water amount.

As shown in FIG. 4, the formed body PC is heated and forcibly dried in the range where the residual water content does not go under 0.5 wt %, and the compression process maybe carried out.

Figure 8:
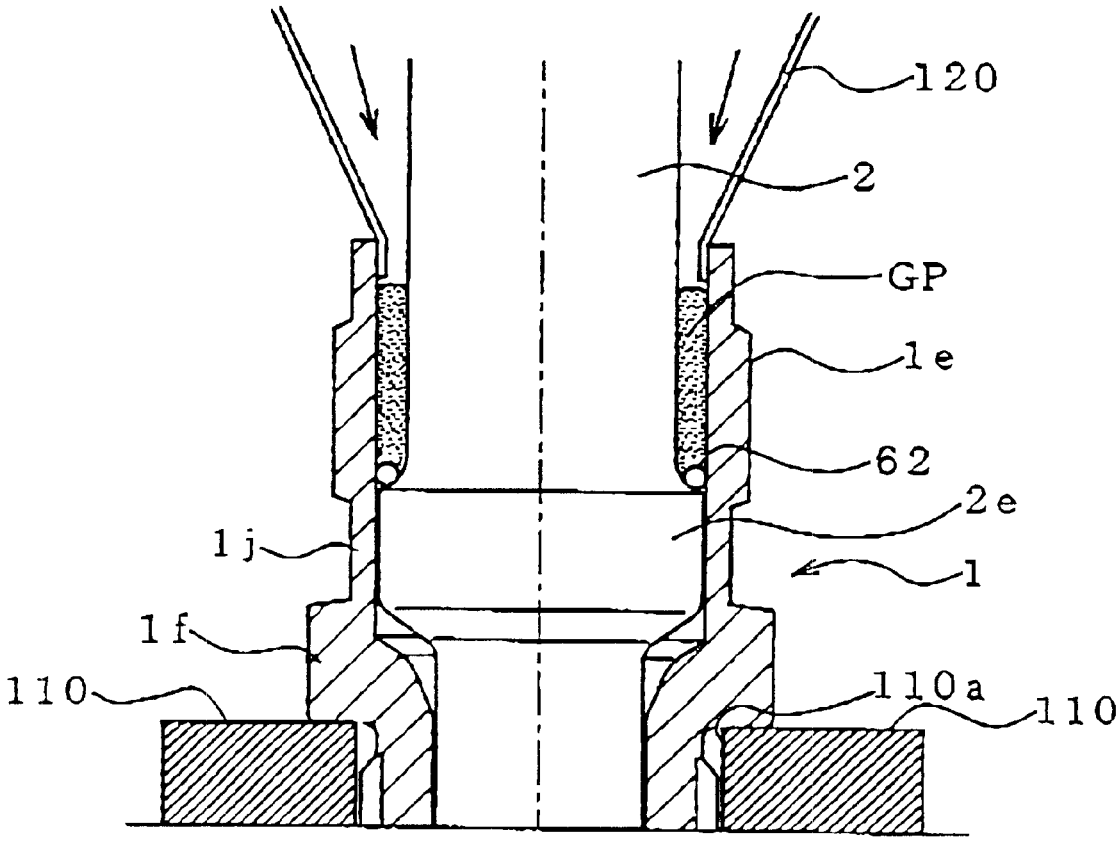
FIG. 8 is an explanatory view showing another process of setting up the spark plug.

As seen in FIG. 8, it is sufficient that the filled material powder is directly filled in the space between the insulator 2 and the metal shell 1 without performing the preliminary forming. In this case, as no forming is done, it is unnecessary to increase the water amount in the filled material powder 1.5 wt % or more suitably to the forming, and the adjustment can be performed in the broad range of 0.5 to 3.5 wt % at the beginning. In FIG. 8, the line filling 62 is previously set in the metal shell 1, and under this condition, a cylindrical tool 120 is attached to the rear-side periphery of the metal shell 1, and the granule sealing material powder GP flows into the first engaging projection 2*e* of the insulator-side and the rear-side of the line filling 62. When the filling 60 is set on the powder GP, the same process as in FIG. 7 may be adopted in the following process.

For confirming the effects of the invention, the under mentioned experiments were made.

The inorganic binder of 5 wt % (the water glass in this example) was mixed in the talc raw material (purity 95% or more) adjusted to an appropriate powder distribution, and fully mixed with an agitator. The mixed powder was passed through a roll pressing machine to be a sheet of 1 to 3 mm, and screened to be coarsely pulverized and classified, and graded to be around 300 to 1000 $\mu$m. The graded powder (filled material powder) was inserted into the space between the outer surface of the insulator of the spark plug and the inner surface of the metal shell in the assembling process, and caulked by the pressing machine. Then, the line packings were provided at the upper and lower parts of the talc filled powder as shown in FIG. 7. In this manner, the test articles 1 to 7 shown in Table 1 were obtained. On the other hand, as the comparison articles, the organic binder (phenol resin in this example) of 5 wt % was mixed, and filled between the outside of the insulator of the spark plug and the inside of the metal shell in the same manner as mentioned above to produce the test articles 8 to 10.

The kinds of the binders and the filling density of the sealing material layer after press-fitting were set in several steps (test articles 1 to 7) for comparing the performance (air-tightness and impact resistance) with that of the existing articles (test articles 8, 9, 10). The testing method depended on Clause 6.4 (impact resistance test) and Clause 6.5 (air-tightness test) of JIS B8031. The filling density was measured by disjointing the articles and measuring the filling amount of the actually sealing material layer with respect to the ring space between the metal shell and the outside of the insulator of placing the sealing material layer In the impact resistance test of Clause 6.4 of JIS B8031, the impact time for 10 minutes was extended to 20 and 30 minutes for evaluating the performance. The results are shown in Table 1. The impact resistance satisfying the performance defined after the test is ○ and that not satisfying is ×. According to the test results, if the filling density of the sealing material layer was 1.5 g/cm$^3$ or more, the defined performance was satisfied though the impact time was 20 minutes, and in case of being 2.0 g/cm$^3$ or more, the performance was maintained through the impact time of 30 minutes.

TABLE 1

| | Kinds of binders | Filling density (g/cm$^3$) | Resulst of heating and airtightness (ml/min) Room temp. | 150° C. | 200° C. | Results of shock resistance 10 min. | 20 min. | 30 min. |
|---|---|---|---|---|---|---|---|---|
| 1* | Inorganic binder | 1.06 | 0 | 0.1 | 0.8 | ○ | × | — |
| 2* | Inorganic binder | 1.24 | 0 | 0.3 | 0.6 | ○ | × | — |
| 3* | Inorganic binder | 1.47 | 0 | 0.2 | 0.7 | ○ | × | — |
| 4 | Inorganic binder | 1.55 | 0 | 0.2 | 0.6 | ○ | ○ | × |
| 5 | Inorganic binder | 2.04 | 0 | 0.1 | 0.8 | ○ | ○ | ○ |
| 6 | Inorganic binder | 2.53 | 0 | 0.3 | 0.7 | ○ | ○ | ○ |
| 7 | Inorganic binder | 2.92 | 0 | 0.2 | 0.5 | ○ | ○ | ○ |
| 8* | Organic binder | 1.08 | 0 | 0.6 | 7.8 | ○ | × | — |
| 9* | Organic binder | 1.27 | 0 | 0.5 | 6.5 | ○ | × | — |
| 10* | Organic binder | 1.43 | 0 | 0.7 | 5.4 | ○ | × | — |

temp.: temperature

As to the heated air-tightness test, in Clause 6.5 of JIS B8031, in addition to the atmospheric temperature of 150° C., the tests were also made at a room temperature (25° C.) and 200° C. for measuring the air leaking amount from the inside of the plug by the technique defined in the air-tightness test. In the case of the atmospheric temperature being 150° C., the sealing material layer by the inorganic binder is lower in the leaking amount than the sealing material layer of the organic binder, and the leakage preventing effect by using the inorganic binder was cleared. In particular, in the case of the atmosphere being 200° C., the sealing material layer of the organic binder measured the air leaking amount exceeding 1 ml/min as the performance standard specified in the air-tightness test. On the other hand, the sealing material layer of the inorganic binder satisfied the performance specified in the air-tightness test, though the atmosphere was 200° C., and it was proved that the air-tightness (sealing property) was maintained favorable at high temperatures. In case silicone based binder (silicone oil, silicone varnish) was used as the binder, substantially the same results were obtained.

If the inorganic binder of the high heat resistance or silicone binder were used as the binder, the heated air-tightness in the spark plug could be increased, and if filling the sealing material powder of the filling density being 1.5 g/cm$^3$ or more after press-fitting (desirably 2.0 g/cm$^3$ or more) between the insulator and the metal shell and press-fitting (connecting) it, the spark plug of the heightened impact resistance could be obtained.

Next, the talc raw material of average diameter being 150 $\mu$m was added with the water glass of 5 wt % as the inorganic binder, fully mixed by the agitator, pressed to be sheet of 1 to 3 mm by the roll pressing machine, unfastened lightly, and screened to classify 300 to 1000 $\mu$m for producing granule filling powder. This powder was inserted between the metal shell 1 and the insulator 2, and pressed by the pipe shaped mold as shown in FIG. 6, and subsequently the metal shell 1 caulked to produce the assembled article as shown in FIG. 7. The filling density of the sealing material layer was controlled per each of the test articles by changing the amount of charging powder and the pressing load. The inner diameter $D_S$ of the metal shell, the outer diameter $D_I$ of the insulator 2, and the opposite side size W of the tool engaging portion 1*e* were set in several steps to assemble the spark plugs for performing the impact test. The impact test was performed, similarly to the test of the Table 1, by using the testing machine specified in the impact resistance test of Clause 6.4 of JIS B8031. In the impact resistance test, the impact time for 10 minutes was changed to 5, 20 and 30 minutes for evaluating the performance. The results are shown in Table 2. In case loosening occurred, that is, the performance defined was not satisfied, × is shown, and in case no loosening occurred, ○ is shown. Further, in the air-tightness of Clause 6.5 of JIS B8031, in addition to the atmospheric temperature of 150° C., the tests were also made at room temperatures and 200° C. for measuring the air leaking amount from the inside of the plug by the technique defined in the air-tightness test. The results are shown in Table 2.

TABLE 2

| | W (mm) | Ds (mm) | D1 (mm) | Ds − D1 (mm) | Filling density (g/cm³) | Results of heating and airtightness (ml/min) Room temp. | 150° C. | 200° C. | Results of shock resistance 5 min. | 10 min. | 20 min. | 30 min. |
|---|---|---|---|---|---|---|---|---|---|---|---|---|
| 11 | 12 | 9.2 | 7.4 | 1.8 | 2.1 | 0 | 0.3 | 0.8 | ○ | ○ | × | — |
| 12 | 12 | 10.2 | 8.4 | 1.8 | 2.1 | 0 | 0.3 | 0.7 | ○ | ○ | ○ | × |
| 13 | 14 | 12.0 | 10.2 | 1.8 | 2.1 | 0 | 0.2 | 0.6 | ○ | ○ | ○ | × |
| 14 | 16 | 12.7 | 10.9 | 1.8 | 2.1 | 0 | 0.3 | 0.7 | ○ | ○ | ○ | × |
| 15 | 12 | 9.2 | 7.0 | 2.2 | 2.5 | 0 | 0.1 | 0.6 | ○ | ○ | ○ | ○ |
| 16 | 12 | 10.2 | 8.0 | 2.2 | 2.5 | 0 | 0.2 | 0.6 | ○ | ○ | ○ | ○ |
| 17 | 14 | 12.0 | 9.8 | 2.2 | 2.5 | 0 | 0.1 | 0.5 | ○ | ○ | ○ | ○ |
| 18 | 16 | 12.7 | 10.5 | 2.2 | 2.5 | 0 | 0.2 | 0.6 | ○ | ○ | ○ | ○ |
| 19 | 12 | 9.2 | 7.0 | 2.2 | 1.4 | 0 | 0.7 | 2.1 | × | — | — | — |
| 20 | 12 | 10.2 | 8.0 | 2.2 | 1.6 | 0 | 0.7 | 1.9 | ○ | × | — | — |
| 21 | 14 | 12.0 | 9.8 | 2.2 | 1.7 | 0 | 0.6 | 1.9 | ○ | × | — | — |
| 22 | 16 | 12.7 | 10.5 | 2.2 | 1.7 | 0 | 0.5 | 1.7 | ○ | × | — | — |
| 23 | 12 | 9.2 | 7.7 | 1.5 | 1.3 | 0 | 0.6 | 2.0 | × | — | — | — |

temp.: temperature

In Table 2, as apparently from the comparison of Nos. 19, 23 and other experimented results, in the case of satisfying $D_S-D_I>1.6$ mm and the filling density of 1.5 g/cm$^3$ at the same time, it was confirmed that the specified performance in the impact resistance for the impact time being 5minutes was satisfied. Comparing Nos. 15to 18 and Nos. 20 to 22 of the same difference in diameter (2.2 mm), In Nos. 15 to 18 of the higher filling density, the impact resistance and the heated air-tightness were improved. In Nos. 15 to 18 of the larger difference in diameter and filling density than Nos. 11 to 14, the impact resistance and the heated air-tightness were both improved, and Nos. 15 to 18 were proved to be very excellent.

The entire disclosure of each and every foreign patent application from which the benefit of foreign priority has been claimed in the present application is incorporated herein by reference, as if fully set forth herein.

We claim:

1. A spark plug comprising:

a center electrode;

an insulator disposed around the center electrode;

a metal shell disposed around the insulator;

a ground electrode disposed in opposition to the center electrode so as to form a spark discharge gap; and a sealing-material layer comprising a sealing material, wherein the sealing material comprises talc, and the sealing-material is filled in a space between the inner face of the metal shell and the outer face of the insulator, so as to seal the space, wherein the sealing material has a filling density of 1.5 g/cm$^3$ to 3.0 g/cm$^3$.

2. The spark plug as set forth in claim 1, wherein the metal shell is formed with a tool-engaging portion for attaching the spark plug to an engine, when a distance between two parallel opposite faces of the tool-engaging portion is W, W<16 mm, an inner diameter $D_S$ of a portion surrounding the sealing-material layer in the metal shell satisfies 9.0 mm<$D_S$<13.0 mm, and when an outer diameter of a portion surrounded by the sealing-material layer in the insulator is $D_I$, $D_S-D_I>1.6$ mm and $D_I>7.0$ mm, and the sealing-material has a filling density of 1.5 g/cm$^3$ to 3.0 g/cm$^3$.

3. The spark plug as set forth in claim 1, wherein the sealing-material layer is maintained liquid at a room temperature, and comprises a binder having a boiling point of 150° C. or higher.

4. The spark plug as set forth in claim 1, wherein the binder contained in the sealing-material layer comprises at least one of an inorganic material and silicone.

5. The spark plug as set forth in claim 4, wherein the binder comprises water glass.

6. The spark plug as set forth in claim 3, wherein the binder contained in the sealing-material layer is 2 to 7 wt %.

7. A spark plug comprising:

a center electrode;

an insulator disposed around the center electrode;

a metal shell provided around the insulator;

a ground electrode disposed in opposition to the center electrode so as to form a spark discharge gap; and a sealing-material layer comprising a sealing material, wherein the sealing material comprises talc, and the sealing material is filled in a space between the inner face of the metal shell and the outer face of the insulator, so as to seal the space, wherein the sealing-material layer comprises at least one of an inorganic material and a silicone binder in an amount of 2 to 7 wt %.

8. The spark plug as set forth in any of claims 1 to 7, wherein, taking, as a front side, a side where the spark discharge gap is formed, a rear-side circumferential part of the metal shell defines a press-fitting portion facing outside.

9. A method of making a spark plug, the spark plug comprising: a center electrode; an insulator provided around the center electrode; a metal shell provided around the insulator; a ground electrode disposed in opposition to the center electrode so as to form a spark discharge gap; and a sealing-material layer comprising a sealing material, wherein the sealing material comprises talc, and the sealing material is filled in a space between the inner face of the metal shell and the outer face of the insulator, so as to seal the space, which comprises:

a filling process of forming a powder-filled layer by i) locating the insulator inside of the metal shell and ii) filling powder of sealing material comprising talc in the space between the metal shell and the insulator;

a compression process of compressing the powder-filled layer in an axial direction of the metal shell so as to form the sealing-material layer; and a forming process of, prior to the filling process, forming the filled powder in a ring shape corresponding to said space, so as to form a formed body, wherein, in the filling process, the formed body of the filled powder is located in said space, and in the compression process, the formed body as the powder filled layer is compressed at a higher pressure than that in the forming process, so that the sealing-material layer is formed having a filling density of 1.5 g/cm$^3$ to 3.0 g/cm$^3$.

10. The method as set forth in claim 9, which further comprising, prior to carrying out the forming process, adjusting talc powder to be the powder of the sealing material, to have an average diameter of 30 $\mu$m to 200 $\mu$m, and an apparent density of 0.5 g/cm$^3$ to 3 g/cm$^3$.

* * * * *